US011723448B2

(12) United States Patent
Gaytan

(10) Patent No.: US 11,723,448 B2
(45) Date of Patent: Aug. 15, 2023

(54) PORTABLE PERSONAL CARE PRODUCT HOLDER

(71) Applicant: Victoria Gaytan, San Antonio, TX (US)

(72) Inventor: Victoria Gaytan, San Antonio, TX (US)

( * ) Notice: Subject to any disclaimer, the term of this patent is extended or adjusted under 35 U.S.C. 154(b) by 0 days.

(21) Appl. No.: 17/218,262

(22) Filed: Mar. 31, 2021

(65) Prior Publication Data

US 2022/0053919 A1 Feb. 24, 2022

Related U.S. Application Data

(60) Provisional application No. 63/067,484, filed on Aug. 19, 2020.

(51) Int. Cl.

| | |
|---|---|
| ***A45F 5/04*** | (2006.01) |
| ***A45F 5/00*** | (2006.01) |
| ***A47K 10/38*** | (2006.01) |

(52) U.S. Cl.

CPC ..... *A45F 5/00* (2013.01); *A47K 10/38* (2013.01); *A45F 2005/008* (2013.01)

(58) Field of Classification Search

CPC .. A45F 5/04; A45F 2005/008; A45F 2200/05; A44C 5/0007; A45C 2011/007; A47K 10/38; A47K 5/1201; A47K 2010/3266

USPC ..... 224/219, 222

See application file for complete search history.

(56) References Cited

U.S. PATENT DOCUMENTS

| | | | | |
|---|---|---|---|---|
| 1,982,248 | A * | 11/1934 | Gebhardt | A44C 5/003 220/DIG. 26 |
| 2,233,157 | A * | 2/1941 | Cahn | A45F 5/04 224/220 |
| 2,482,584 | A * | 9/1949 | Harris | A44C 5/0046 63/11 |
| 3,647,059 | A * | 3/1972 | Humphreys | G02C 13/006 242/598.5 |
| 5,127,545 | A * | 7/1992 | French | A45F 5/00 221/199 |
| 5,699,904 | A * | 12/1997 | Ikemoto | A47G 25/78 242/395 |
| 6,471,091 | B1 * | 10/2002 | Unverzagt | B65C 11/00 221/33 |

(Continued)

OTHER PUBLICATIONS

JP 2001180769, Machine Translation, retrieved Sep. 22, 2022. (Year: 2001).*

JP2001180769, Dec. 1999, by Soga. (Year: 2001).*

*Primary Examiner* — Adam J Waggenspack

(74) *Attorney, Agent, or Firm* — Brennan, Manna & Diamond, LLC

(57) ABSTRACT

A portable dispenser configure to retain tissues, wipes, handkerchiefs, or similar convenience items. The portable dispenser comprises a band with two ends which can be closed and adjusted to size the device to the appendage of a user using a closure mechanism. A dispensing component is attachable to or is integrated into the band. The dispensing component has a slit with a fastening mechanism for accessing the tissues, wipes or handkerchiefs stored inside the pouch. The dispensing component may be configured to accept a roll of tissues or wipes. The device of the present invention can be a wrist band, arm band, bracelet, smartwatch or the like, that makes the tissues, wipes or handkerchiefs readily available as needed.

1 Claim, 4 Drawing Sheets

(56) References Cited

U.S. PATENT DOCUMENTS

| | | | | |
|---|---|---|---|---|
| 6,550,635 | B1 * | 4/2003 | King | A47K 10/42 221/33 |
| 6,644,694 | B2 * | 11/2003 | Seawright | B42D 15/0086 2/160 |
| 6,971,542 | B2 * | 12/2005 | Vogel | B65H 45/24 221/45 |
| 7,735,682 | B1 * | 6/2010 | Cassel | A47K 10/38 221/24 |
| 9,010,592 | B1 * | 4/2015 | Toon, Jr. | A45F 5/00 224/576 |
| 9,968,179 | B2 * | 5/2018 | Patel | B65D 83/0805 |
| 2002/0000455 | A1 * | 1/2002 | Condliff | A45F 5/004 224/162 |
| 2002/0084279 | A1 * | 7/2002 | Lickstein | A47K 10/42 221/24 |
| 2006/0208130 | A1 * | 9/2006 | Castor | A47K 10/38 242/598.6 |
| 2008/0190974 | A1 * | 8/2008 | Finn | A45F 5/00 224/267 |
| 2012/0255978 | A1 * | 10/2012 | Williams | A45F 5/00 224/219 |
| 2013/0104599 | A1 * | 5/2013 | Beldiman | A44C 5/003 63/1.14 |
| 2014/0367405 | A1 * | 12/2014 | Gerasimova | A45F 5/00 221/45 |
| 2018/0263436 | A1 * | 9/2018 | Bartrug | A47K 10/424 |
| 2019/0021418 | A1 * | 1/2019 | Jury | A47K 10/32 |

* cited by examiner

PORTABLE PERSONAL CARE PRODUCT HOLDER

CROSS-REFERENCE TO RELATED APPLICATION

The present application claims priority to, and the benefit of, U.S. Provisional Application No. 63/067,484, which was filed on Aug. 19, 2020 and is incorporated herein by reference in its entirety.

BACKGROUND

The present invention relates generally to the field of convenience product storage. More specifically, the present invention relates to a wearable device for storing tissues, handkerchiefs, wet wipes, or the like for the convenience of the user. The wearable device stores the tissues, wet wipes, or handkerchiefs and enables a user to access the tissues, wet wipes, or handkerchiefs when needed. Accordingly, the present specification makes specific reference thereto the present invention. However, it is to be appreciated that aspects of the present invention are also equally amenable to other like applications, devices and methods of manufacture.

By way of background, a handkerchief, wet wipe, or a tissue is known for its various uses. For example, cleaning surfaces, wiping hands, wiping, and blowing one's nose, wiping sweat, wiping tears, temporary mouth and nose covering, and more. Additionally, the handkerchiefs, wet wipes, and/or the tissues are frequently used for accessing frequently touched surfaces such as door handles, keypads, gas pumps, lifts, or the like, particularly during times of a pandemic or epidemic. A handkerchief, wet wipe, or tissue is considered one of the essential items carried with a user and readily available when required.

Further, in the times of pandemics such as influenza pandemic, COVID-19 or the like, any infectious disease spreads easily across a large region potentially affecting a substantial number of individuals. People may easily transmit viruses, bacteria, air-borne pathogens, contagions, or other harmful pathogens by cross contamination. As such, it is important to prevent or limit the transmission of such harmful pathogens and thereby prevent the spread of disease during such outbreaks. As a preventive measure, people use tissues, wet wipes, or handkerchiefs frequently while sneezing, cleaning surfaces, or to touch any surface that might be infected.

Handkerchiefs, wet wipes, or tissues may be not be readily and easily available at all the places when required by the users. For this reason, people need to carry a handkerchief, a wet wipe, or packet of tissues while being away from the home or office. However, when the user forgets to carry the handkerchief, sanitizing or wet wipe, or tissue, individuals often end up using their hands to touch infected surfaces such as gas pumps, doorknobs, keypads, etc. This can lead to the transmission of bacteria, germs, and viruses among people. Also, if sanitizer is not immediately available, individuals can further transmit these germs by touching other surfaces or people. Further, individuals often sneeze or cough without having a tissue or wipe readily available which can also contribute to the spread of germs due to the air borne nature of the germs, viruses or bacteria. These situations elevate the spread of various infectious and diseases.

Additionally, handkerchiefs, wipes, or tissues are frequently required with children, for wiping their nose, hands, mouth, cleaning up after them, or the like. However, it is quite inconvenient to remember to carry a package of tissues or wipes every time an adult is out with the children. Additionally, hand dryers are increasingly only available to dry hands in restrooms. These loud dryers tend to scare young children and can be a nuisance for individuals with noise sensitivities. Further, for carrying the tissues or wipes, it is inconvenient to carry tissue or wipe bulky containers, as the containers can be quite large may not easily fit into the wallets or purse of individual users. A solution for improving the availability of handkerchiefs, wipes or tissues to the user is required.

Therefore, there exists a long felt need in the art for a handkerchief, sanitizing wipe, or tissue storing device that enables a user to deploy a handkerchief, wipe, or tissue in a quick, convenient, and aesthetic manner. There is also a long felt need in the art for a handkerchief, wipe or tissue which is portable. There is also a long felt need in the art for a tissue, wipe or handkerchief holder which is light weight and can easily be carried to different places. There is also a long felt need in the art for handkerchief, wipe or tissue holders which can be easily utilized by adults or children without any inconvenience. Additionally, there is a long felt need in the art for a holder that enables to carry tissue, wipes or handkerchief in the same device. Finally, there is a long felt need in the art for a handkerchief, wipe, or tissue holder that makes the handkerchiefs, wipes or tissues readily available to the users without any hassles.

In this manner, the wearable device for storing a convenience product of the present invention accomplishes all of the forgoing objectives and provides a relatively quick and easy solution to deploy tissue, wipes or handkerchiefs according to the preferences of the user. The wearable device is also portable inasmuch as it is small in size and lightweight. Finally, the wearable device of the present invention makes the tissue, wipe or handkerchief readily available for use as and when required by the users for different purposes.

SUMMARY

The following presents a simplified summary in order to provide a basic understanding of some aspects of the disclosed innovation. This summary is not an extensive overview, and it is not intended to identify key or critical elements or to delineate the scope thereof. Its sole purpose is to present some concepts in a simplified form as a prelude to the more detailed description that is presented later.

The subject matter disclosed and claimed herein, in one embodiment thereof, comprises a portable dispenser for retaining and dispensing a convenience product. The convenience product may comprise tissues, sanitizing wipes, handkerchiefs, or the like. The convenience product may be supplied as a single unit, a continuous format, a Z fold format, or a C fold format of the product. The portable dispenser may be configured as a consumer accessory such as wrist band, smart watch, bracelet, arm band or the like. The portable dispenser comprises a band and a dispensing component.

The band comprises a first end and a second end. The first and second ends cooperate with each other to form a closure via a pair of attachment elements each disposed on one of the first and second ends. The pair of attachment elements may be a hook and loop fastening system, snaps, a buckle, a button, or a magnetic closure. The band is flexible and configured to extend around a wrist or attach to a backpack, belt loop, briefcase, purse, or the like.

The dispensing component is integrated into a portion of the band in between the first and second ends. The dispensing component comprises a reservoir for retaining the convenience product. The reservoir is a cavity within the dispensing component configured as a flexible pouch sized and constructed to hold a supply of the convenience product. The dispensing component further comprises a closable opening in the dispensing component for allowing access to the reservoir. The closable opening is a horizontally disposed slit in the dispensing component that is openable laterally. The reservoir may be refilled through the closable opening when the supply of the convenience product is depleted.

The dispensing component further comprises a closure element for opening and closing the closable opening. The closure element may comprise a zipper, a hook and loop fastening system, a resealable adhesive, a memory closure, or other fastening methods for closing a slit opening. The dispensing component may further comprise an attachment element positioned within the reservoir. The attachment element may be a ring, a clip, a clasp, or similar fastener configured to attach a handkerchief inside the reservoir.

In an additional embodiment, a portable dispenser for retaining and dispensing a convenience product is disclosed. As before, the convenience product may comprise tissues, sanitizing wipes, handkerchiefs, or the like. The convenience product may be supplied as a single unit, a continuous format, a Z fold format, or a C fold format of the product. The portable dispenser may be configured as a consumer accessory such as wrist band, smart watch, bracelet, arm band or the like. The portable dispenser comprises a band and a dispensing component.

The band comprises a first end and a second end. The first and second ends cooperate with each other to form a closure via a pair of attachment elements each disposed on one of the first and second ends. The pair of attachment elements may be a hook and loop fastening system, snaps, a buckle, a button, or a magnetic closure. The band is flexible and configured to extend around a wrist or attach to a backpack, belt loop, briefcase, purse, or the like. The band further comprises a dispensing component attachment element located on an outer surface of the band between the first and second ends. The dispensing component attachment element may be a magnetic fastening system, a hook and loop fastening system, a snap, a slot and friction system, or the like.

The dispensing component comprises housing and a reservoir within the housing for retaining the convenience product. The reservoir is a cavity within the housing configured as a flexible pouch sized and constructed to hold a supply of the convenience product. The housing is mountable to the dispensing component attachment element on the portion of the band in between the first and second ends. The dispensing component further comprises a closable opening in the dispensing component for allowing access to the reservoir. The closable opening is a horizontally disposed slit in the dispensing component that is openable laterally. The reservoir may be refilled through the closable opening when the supply of the convenience product is depleted.

The dispensing component further comprises a closure element for opening and closing the closable opening. The closure element may comprise a zipper, a hook and loop fastening system, a resealable adhesive, a memory closure, or other fastening methods for closing a slit opening. The dispensing component may further comprise an attachment element positioned within the reservoir. The attachment element may be a ring, a clip, a clasp, or similar fastener configured to attach a handkerchief inside the reservoir.

In an additional embodiment, a portable dispenser for retaining and dispensing a convenience product is disclosed. As before, the convenience product may comprise tissues, sanitizing wipes, or the like. The convenience product is supplied as a roll of convenience product disposed on a roll core. The portable dispenser may be configured as a consumer accessory such as wrist band, smart watch, bracelet, arm band or the like. The portable dispenser comprises a band and a dispensing component.

The band comprises a first end and a second end. The first and second ends cooperate with each other to form a closure via a pair of attachment elements each disposed on one of the first and second ends. The pair of attachment elements may be a hook and loop fastening system, snaps, a buckle, a button, or a magnetic closure. The band is flexible and configured to extend around a wrist or attach to a backpack, belt loop, briefcase, purse, or the like.

The dispensing component is integrated into a portion of the band in between the first and second ends. The dispensing component comprises a reservoir for retaining the convenience product. The reservoir is a nondeformable cavity within the dispensing component comprising a pair of mounting points. The roll core of the convenience product is loaded into the reservoir and secured within the reservoir by the pair of mounting points.

The dispensing component further comprises a closable opening in the dispensing component for allowing access to the reservoir. The closable opening comprises a flap that folds over to form a slot. The reservoir may be refilled through the closable opening when the supply of the convenience product is depleted. The dispensing component further comprises a closure element for opening and closing the closable opening. The closure element may comprise a zipper, a hook and loop fastening system, a resealable adhesive, a memory closure, or other fastening methods for closing slot when the flap is folded over.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DESCRIPTION

Figure 1:
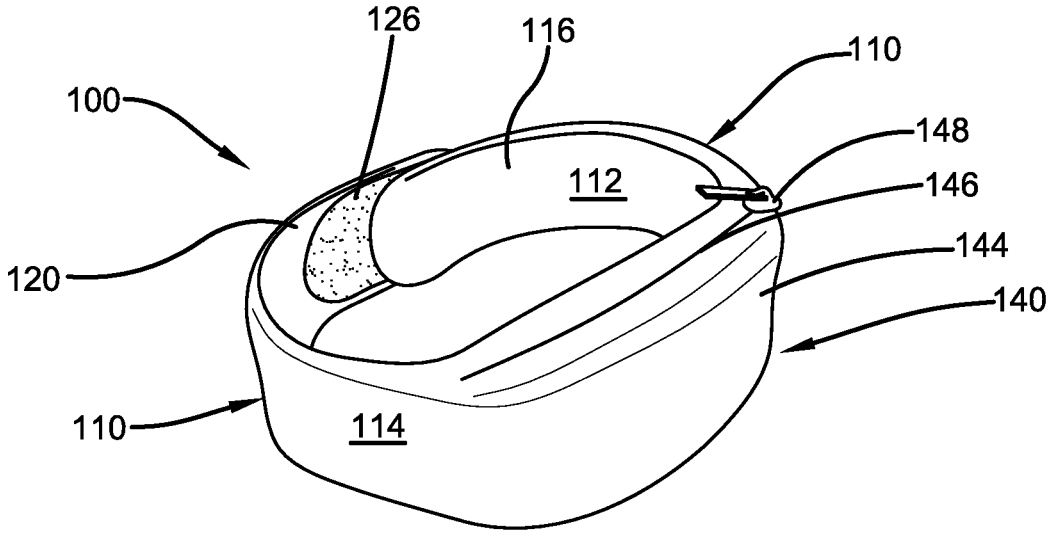
FIG. 1 illustrates a perspective view of one embodiment of a portable dispenser of the present invention for dispensing a convenience product in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists a long felt need in the art for a handkerchief, sanitary wipe or tissue storing device that enables a user to deploy a handkerchief, wipe or tissue in a quick, convenient, and aesthetic manner. There is also a long felt need in the art for a handkerchief, wipe or tissue which is portable. There is also a long felt need in the art for a tissue or wipe holder which is light weight and can easily be carried to different places. There is also a long felt need in the art for a handkerchief, sanitary wipe, or tissue carrying solution which are easy to implement. There is also a long felt need in the art for handkerchief, wipe or tissue holders which can be easily utilized by adults or children without any inconvenience. Additionally, there is a long felt need in the art for a holder that enables the carrying of tissues, wipes, or handkerchiefs in the same device. Finally, there is a long felt need in the art for a handkerchief, wipe, or tissue holder that makes the handkerchiefs, wipes, or tissues readily available to the users without any inconvenience.

The innovative product of the present invention features a wrist or arm worn device for storing tissues, wipes or handkerchiefs, thereby making these essential items readily available to the users. The device is made up of an elastic polymeric material and can be easily worn on the wrist or arm and can be adjusted to any wrist or arm size using a band closure mechanism. The device includes a pouch having a slit to allow a user to insert tissues, wipes or handkerchiefs through the slit or opening. The slit or opening is fastened using a zipper, resealable adhesives or hook and loop technologies. The wrist or arm worn device of the present invention permits easy access of the tissue, wipe or handkerchief for use during sports, gardening or other activities that make it inconvenient to find a tissue or other convenience product, especially when the hands are dirty or holding items. The device of the present invention fits on either hand or arm of a user and to hand of a user of different ages such as adult or children. The innovative tissue, wipe or handkerchief holder offers a more convenient solution for individuals for making the tissues, wipes or handkerchiefs readily available.

The present invention, in one exemplary embodiment, is a wrist or arm worn device having a pouch for storing and/or holding tissues, wipes or handkerchiefs. The pouch is accessible by using a zipper, resealable adhesives or hook and loop fastener or other fastening methods on a slit positioned on the pouch. The wrist or arm worn device may be worn by users of any age group such as adults or children and the device may be adjustable to accommodate the size of the wrist or arm of different users by using hook and loop fasteners, buckles, clasps or other fastening mechanisms. Additionally, the pouch of the wrist or arm worn device also includes a ring or a clip to hold the handkerchief inside the it and may also include protrusions for holding a small tissue or wipe roll inside the pouch. A user may use the wrist or arm worn device such as wristband, bracelet or the like for storing tissues or handkerchiefs as per the preferences of the user. The device may be refilled through the slit or opening when the initial supply has been exhausted. The band assembly may be available in a variety of colors, patterns, and designs to suit the requirements of different users. The device may be made up of nylon, neoprene, polypropylene or natural rubber, and may be waterproof.

Referring initially to the drawings, FIGS. 1-6 illustrates a portable dispenser 100 for retaining and dispensing a convenience product 10. The convenience product 10 may comprise tissues, sanitizing wipes, handkerchiefs, or the like. The convenience product 10 may be supplied as a single unit, a continuous format, a Z fold format, or a C fold format of the product. The portable dispenser 100 may be configured as a consumer accessory such as wrist band, smart watch, bracelet, arm band or the like. The portable dispenser 100 may be personalized or decorated with logos, trademarks, trade names, words and may also contain various graphics.

The portable dispenser 100 can be constructed as any device that can extend around and be easily worn on an appendage, such as a hand or arm of a user in the form of a wristband, bracelet, arm band, smartwatch, or the like. The portable dispenser 100 can be constructed of different materials ranging from a disposable or a recyclable material such as a flexible rubber or plastic material for a designer feel. For example, the portable dispenser 100 may be plastic, rubber, or other elastic material, or may be made up of metal, or the like, as per the preferences of a user. The portable dispenser 100 may also be adjustable and customizable in size.

Figure 2:
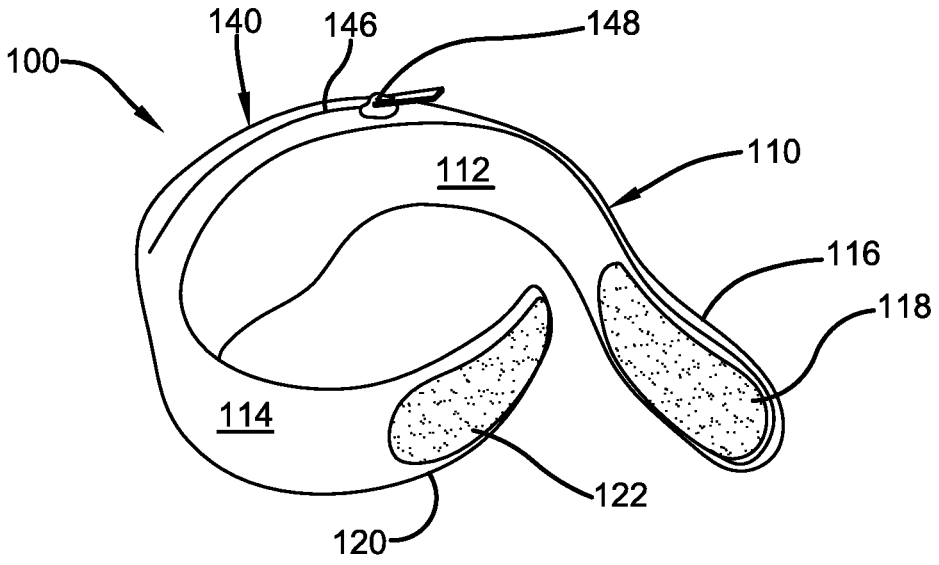
FIG. 2 illustrates a rear perspective view of the portable dispenser of the present invention for dispensing a convenience product in accordance with the disclosed architecture.

As illustrated in FIGS. 1 and 2, the portable dispenser 100 comprises a band 110 and a dispensing component 140. The band 110 comprises a first end 116 and a second end 120. The first and second ends 116 and 120 cooperate with each other to form a closure via a pair of attachment elements 118 and 122 each disposed on one of the first and second ends 116 and 120. The pair of attachment elements 118 and 122 may be a hook and loop fastening system, snaps, a buckle, a button, or a magnetic closure. The band 110 further comprises an inner surface 112, referring to the surface in contact with the skin of the user's wrist or arm, and an outer surface 114 positioned away from the user's skin. The outer surface 114 is visible to other users and can display different colors, designs, patterns, customized data, logo, and other similar information as per the preferences of the user. The outer surface 114 is designed so as to make the portable dispenser 100 aesthetically appealing and is customized to suit requirements of different users. The band 110 is flexible and configured to extend around a wrist or attach to a backpack, belt loop, briefcase, purse, or the like. The band 110 may be substantially C-shaped or circumferentially extending cross section, for example, an approximately circular or oval band with a cut-out to allow for the band 110 to be donned onto a user's arm or wrist.

Figure 3:
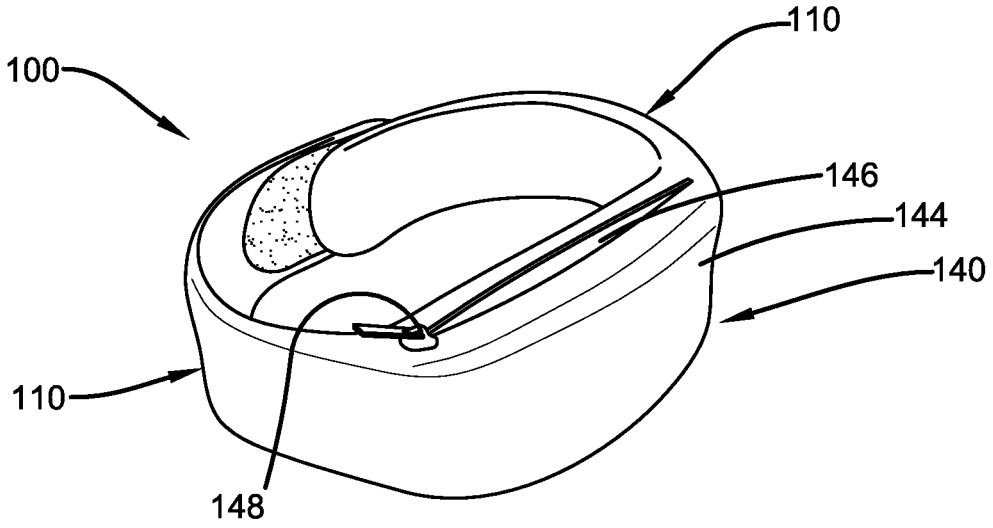
FIG. 3 illustrates a perspective view of a reservoir of the portable dispenser in an open configuration of the present invention for dispensing a convenience product in accordance with the disclosed architecture.

The dispensing component 140 is integrated into a portion of the band 110 in between the first and second ends 116 and 120. The dispensing component 140 comprises a reservoir 144 for retaining the convenience product 10. The reservoir 144 is a cavity within the dispensing component 140 configured as a flexible pouch, sized and constructed to hold a supply of the convenience product 10. The dispensing component 140 further comprises a closable opening 146 in the dispensing component 140 for allowing access to the reservoir 144. The closable opening 146 is a horizontally disposed slit in the dispensing component 140 that is openable laterally as illustrated in FIG. 3. The closable opening 146 is disposed perpendicularly to the inner and outer surfaces 112 and 114 of the band 110 to facilitate the dispending of the product 10. The reservoir 144 may be also be refilled through the closable opening 146 when the supply of the convenience product 10 is depleted.

Figure 4:
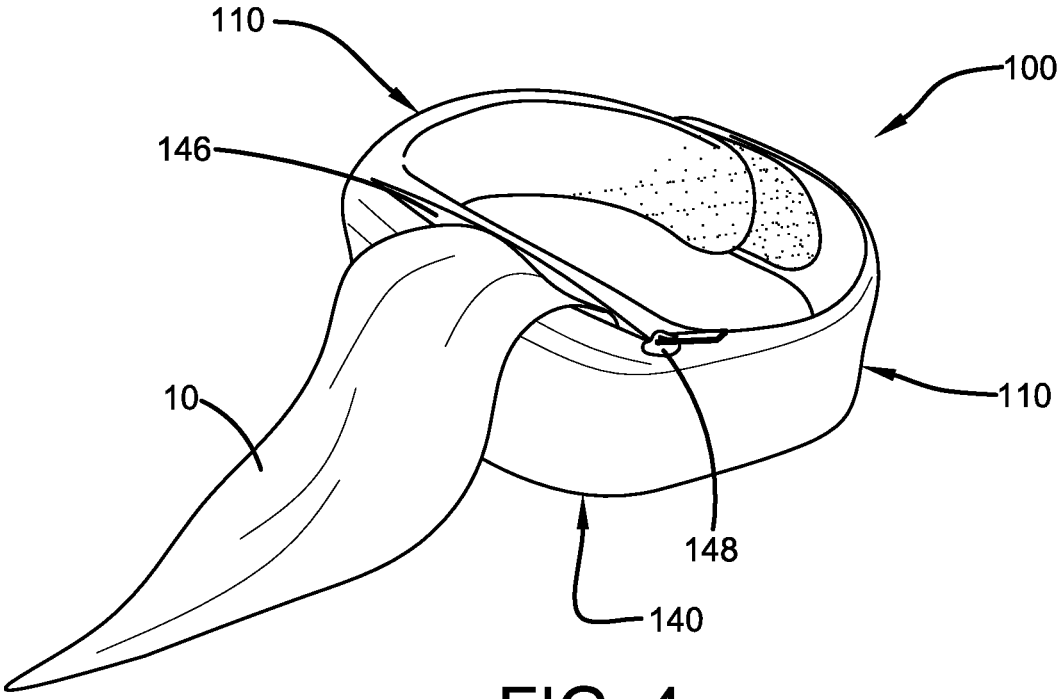
FIG. 4 illustrates a perspective view of the portable dispenser of the present invention dispensing a convenience product in accordance with the disclosed architecture.
Figure 5:
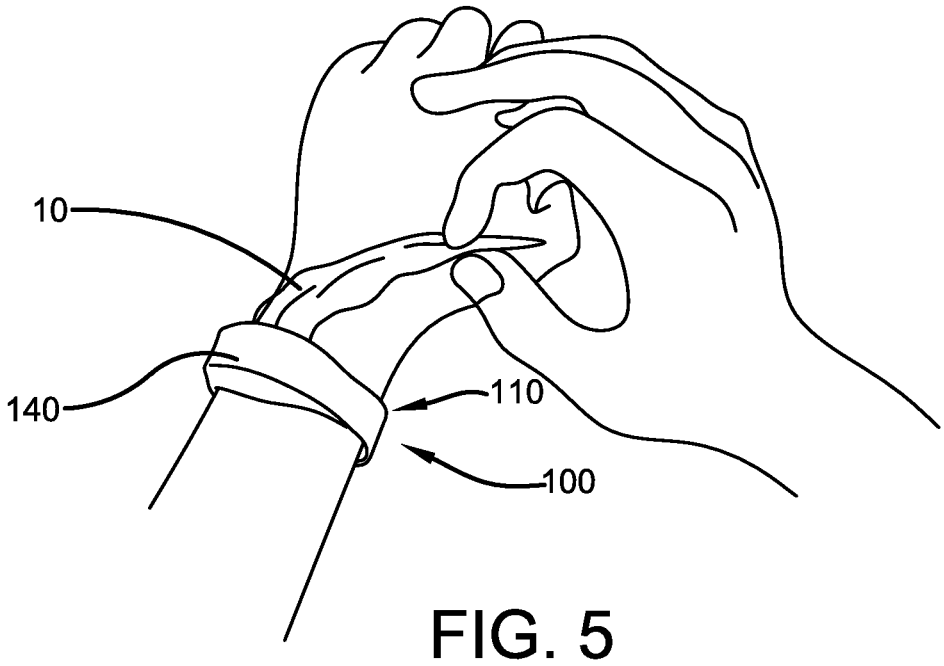
FIG. 5 illustrates a user removing a convenience product from the portable dispenser of the present invention while worn on the user's wrist in accordance with the disclosed architecture.

The dispensing component 140 further comprises a closure element 148 for opening and closing the closable opening 146. The closure element 148 may comprise a zipper, a hook and loop fastening system, a resealable adhesive, a memory closure, or other fastening methods for closing a slit opening. To dispense the convenience product 10, the user pulls the convenience product 10 through the closable opening 146 when the closure element 148 is opened as illustrated in FIGS. 4 and 5. The convenience product 10 may be configured as a number of tissues or wipes stacked one over another in a "z" folded or "c" folded configuration so that one tissue or wipe pulls the leading edge of the next tissue or wipe toward the direction of the slit or opening for dispensing.

Figure 6:
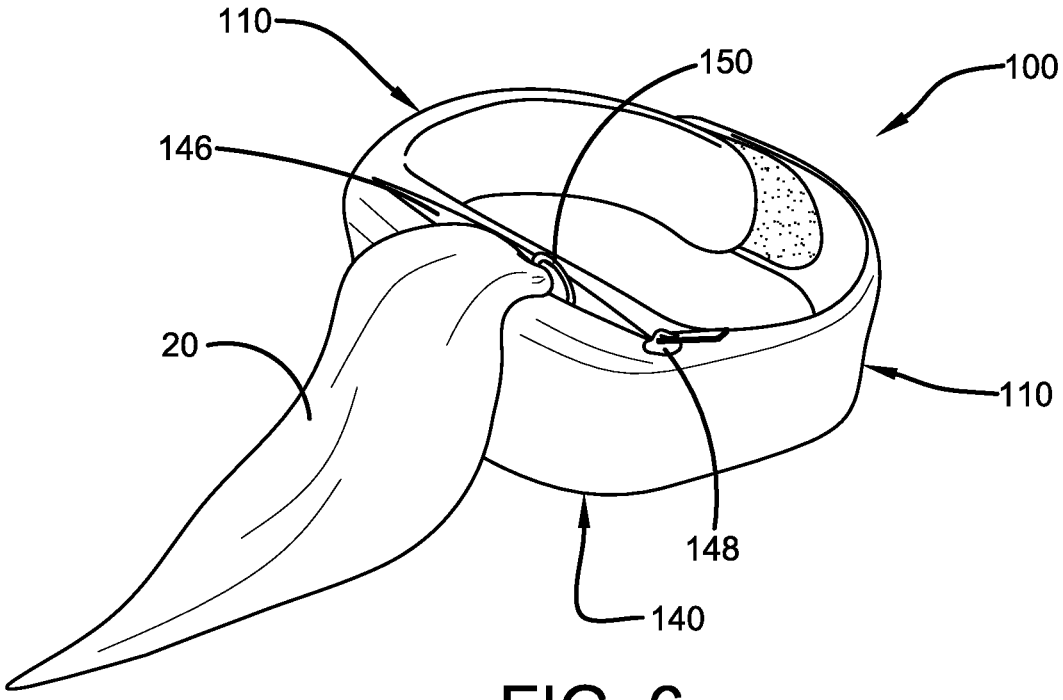
FIG. 6 illustrates a perspective view of an attachment point of the dispensing component of the portable dispenser of the present invention retaining a handkerchief in accordance with the disclosed architecture.

The dispensing component 140 may further comprise an attachment element 150 positioned within the reservoir 144 as illustrated in FIG. 6. The attachment element 150 may be a ring, a clip, a clasp, or similar fastener configured to attach a handkerchief 20 inside the reservoir 144. The handkerchief 20 may be clipped to the attachment element 150 to be properly stored inside the reservoir 144 and for being easily accessible to the user. For accessing the handkerchief 10, the user may open the closable opening 146 by unzipping the closure element 148 and then remove the handkerchief 20 by pulling out one of its ends through the closable opening 146 of the pouch 110. Once the handkerchief 600 is removed from the reservoir 144, the user may close the closable opening 146 by the closure element 148. The user may refill the handkerchief 20 in a similar manner as well.

Figure 7:
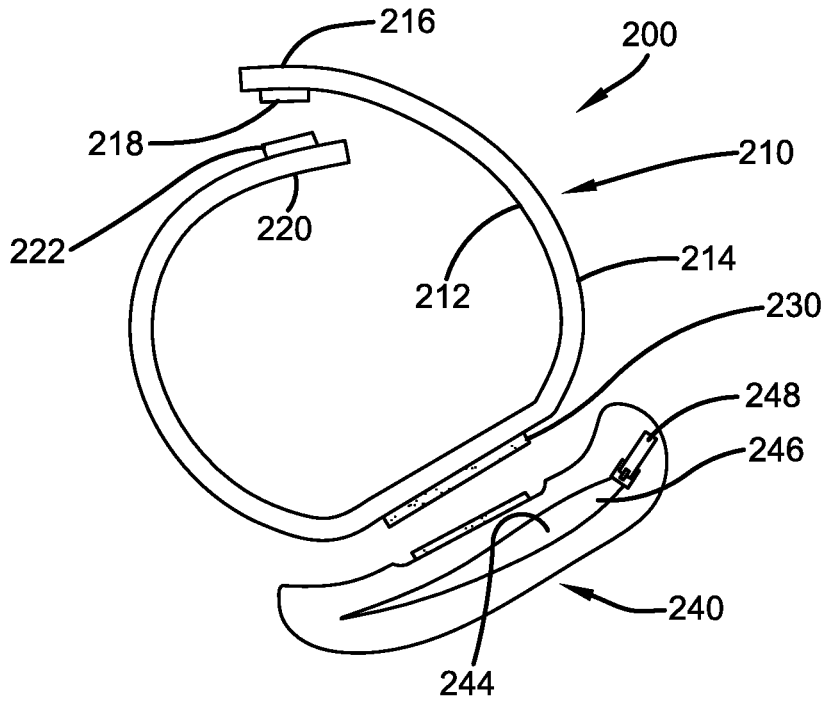
FIG. 7 illustrated an exploded view of a band and a dispensing component of a portable dispenser of the present invention for dispensing a convenience product in accordance with the disclosed architecture.

In an additional embodiment as illustrated in FIG. 7, a portable dispenser 200 for retaining and dispensing a convenience product 10 is disclosed. As before, the convenience product 10 may comprise tissues, sanitizing wipes, handkerchiefs, or the like. The convenience product 10 may be supplied as a single unit, a continuous format, a Z fold format, or a C fold format of the product. The portable dispenser 200 may be configured as a consumer accessory such as wrist band, smart watch, bracelet, arm band or the like. The portable dispenser 200 comprises a band 210 and a dispensing component 240.

The band 210 comprises a first end 216 and a second end 220. The first and second ends 216 and 220 cooperate with each other to form a closure via a pair of attachment elements 218 and 222 each disposed on one of the first and second ends 216 and 220. The pair of attachment elements 218 and 222 may be a hook and loop fastening system, snaps, a buckle, a button, or a magnetic closure. The band 210 further comprises an inner surface 212, referring to the surface in contact with the skin of the user's wrist or arm, and an outer surface 214 positioned away from the user's skin. The band 210 is flexible and configured to extend around a wrist or attach to a backpack, belt loop, briefcase, purse, or the like. The band 210 may be substantially C-shaped or circumferentially extending cross section, for example, an approximately circular or oval band with a cut-out to allow for the band 210 to be donned onto a user's arm or wrist.

The band 210 further comprises a dispensing component attachment element 230 located on the outer surface 214 of the band 210 between the first and second ends 216 and 220. The dispensing component attachment element 230 may be a magnetic fastening system, a hook and loop fastening system, a snap, a slot and friction system, or the like.

The dispensing component 240 comprises a housing 242 and a reservoir 244 within the housing 242 for retaining the convenience product 10. The reservoir 244 is a cavity within the housing 242 configured as a flexible pouch sized and constructed to hold a supply of the convenience product 10. The housing 242 is detachable from and mountable to the dispensing component attachment element 230 on the portion of the band 210 in between the first and second ends 216 and 220, typically centrally positioned between the first and second ends 216 and 220. The dispensing component 240 further comprises a closable opening 246 in the dispensing component 240 for allowing access to the reservoir 244. The closable opening 246 is typically a horizontally disposed slit in the dispensing component 240 that is openable laterally. The closable opening 246 is disposed perpendicularly to the inner and outer surfaces 212 and 214 of the band 210 to facilitate the dispending of the product 10. The reservoir 244 may be refilled through the closable opening 246 when the supply of the convenience product 10 is depleted.

The dispensing component 240 further comprises a closure element 248 for opening and closing the closable opening 246. The closure element 248 may comprise a zipper, a hook and loop fastening system, a resealable adhesive, a memory closure, or other fastening methods for closing a slit opening. To dispense the convenience product 10, the user pulls the convenience product 10 through the closable opening 246 when the closure element 248 is opened. The dispensing component 240 may further comprise an attachment element (similar to 150) positioned within the reservoir 244. The attachment element may be a ring, a clip, a clasp, or similar fastener configured to attach a handkerchief 20 inside the reservoir 244. The handkerchief 20 may be clipped to the attachment element to be properly stored inside the reservoir 144 and for being easily accessible to the user.

Figure 8:
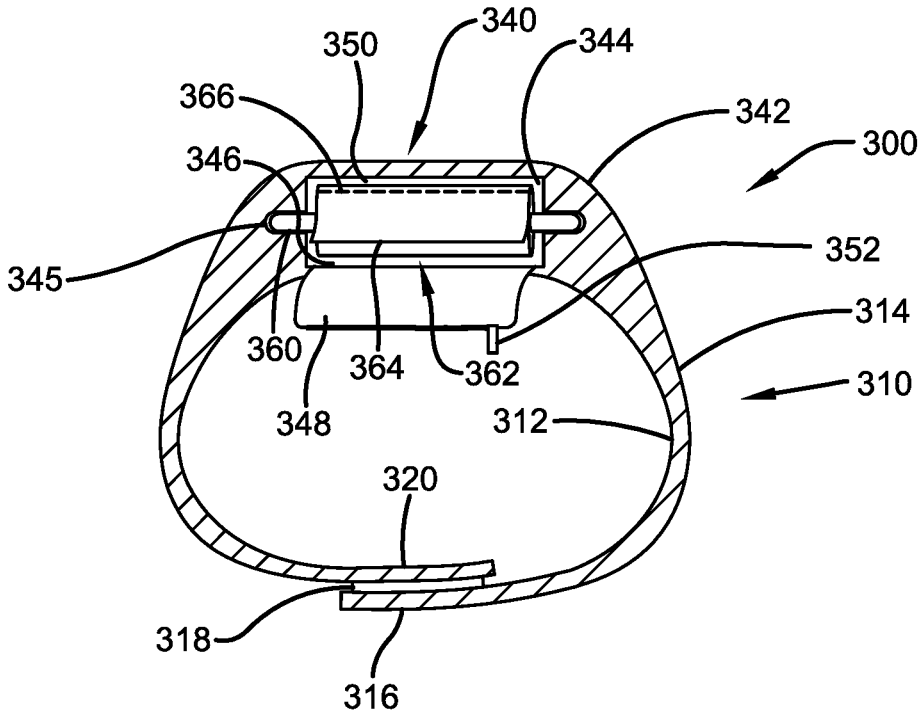
FIG. 8 illustrates a sectional view of a portable dispenser of the present invention for dispensing a convenience product in accordance with the disclosed architecture.

In an additional embodiment as illustrated in FIG. 8, a portable dispenser 300 for retaining and dispensing a convenience product 10 is disclosed. As before, the convenience product 10 may comprise tissues, sanitizing wipes, or the like. The convenience product 10 is supplied as a roll 362 of convenience product disposed on a roll core 360. The portable dispenser 300 may be configured as a consumer accessory such as wrist band, smart watch, bracelet, arm band or the like. Individual sheets or tissues or wipes 10 are connected to one another by a line of perforations, which use a series of cuts and ties in the roll 362. The number of perforations or cuts 366 between individual sheets 364 determines the holding pressure of the continuous supply. The perforations or cuts 366 in the tissue roll 362 enables the user to easily remove one tissue or wipe 364 at a time. By connecting the tissues or wipes together and held by a perforation line, the tissue or wipes can be dispensed in a continuous fashion.

The portable dispenser 1300 comprises a band 310 and a dispensing component 340. The band 310 comprises a first end 316 and a second end 320. The first and second ends 316 and 320 cooperate with each other to form a closure 318. The closure 318 may be a hook and loop fastening system, snaps, a buckle, a button, or a magnetic closure. The band 310 further comprises an inner surface 312, referring to the surface in contact with the skin of the user's wrist or arm, and an outer surface 314 positioned away from the user's skin. The outer surface 314 is visible to other users and can display different colors, designs, patterns, customized data, logo, and other similar information as per the preferences of the user. The outer surface 314 is designed so as to make the portable dispenser 300 aesthetically appealing and is customized to suit requirements of different users. The band 310 is flexible and configured to extend around a wrist or attach to a backpack, belt loop, briefcase, purse, or the like. The band 310 may be substantially C-shaped or circumferentially extending cross section, for example, an approximately circular or oval band with a cut-out to allow for the band 310 to be donned onto a user's arm or wrist.

The dispensing component 340 is integrated into a portion of the band 310 in between the first and second ends 316 and 320. The dispensing component 340 comprises a housing 342 and a reservoir 344 within the housing 342 shaped to retain the roll 360 of the convenience product 10. The reservoir 344 is a nondeformable cavity within the housing 342 comprising a pair of mounting points 345. The roll core 360 of the convenience product 10 is loaded into the reservoir 344 and secured within the reservoir 344 by the pair of mounting points 345.

The dispensing component 340 further comprises a closable opening 346 in the housing 342 for allowing access to the reservoir 344. The closable opening 346 comprises a flap 348 that folds over to leave and form a slot opening 350. The reservoir 344 may be refilled through the closable opening 346 when the supply of the convenience product 362 is depleted. The dispensing component 340 further comprises a closure element 352 for opening and closing the closable opening 346. The closure element 352 may comprise a zipper, a hook and loop fastening system, a resealable adhesive, a memory closure, or other fastening methods for closing the slot 350 when the flap 348 is folded over.

In an embodiment of the present invention, the portable dispenser 100 may include various sensors to monitor health parameters or the like and may be include wireless communication modules, to enable a user to connect the portable dispenser 100 to various other devices such as a smartphone, iPod, laptop or the like.

The portable dispenser 100, 200, and 300 of the present invention can hold a plurality of tissues or wipes, such as up to ten or more. Of course, more or less tissue may be stowed. The tissues or wipes may be folded relative to one another such that fully removing one tissue causes the next tissue to be partially deployed. Similarly, the tissue may be interconnected via perforations, so that the user would need to tear off one tissue for use. The tissue need not be so interleaved or interconnected, as the present invention is not limited in this regard. The tissue may be anti-bacterial hand wipes, medically treated tissue, anti-viral tissue, sanitary wipes, and cleaning wipes. The tissue may be either wet or dry, as the present invention is not limited in this regard.

The portable dispenser 100, 200, and 300 may be worn near or on a person's wrist, forearm or upper arm. The portable dispenser 100, 200, and 300 may be worn at any desirable location. The portable dispenser 100, 200, and 300 is sized and shaped to be worn directly on the person's body or alternatively may be sized and shaped to be worn over the person's clothing. The portable dispenser 100, 200, and 300 may be attached to a user's clothing using a pin, zipper, spring biased clip or other means. These described connectors for attaching the wearable tissue or wipe holder are in contrast to the user simply carrying tissues or wipes in the shirt pocket.

The portable dispenser 100, 200, and 300 facilitates hands-free transport and convenient delivery of facial tissues, dry tissue, wipes or any other tissue or wipe known in the art. The portable dispenser 100, 200, and 300 renders tissues or wipes constantly available to a bed-confined user, without necessity of box access. The portable dispenser 100, 200, and 300 allows non-cumbersome transport of tissues by an individual user for personal use. The portable dispenser 100, 200, and 300 protects tissues or wipes from tearing and degradation during storage and transport.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "wrist worn device", "wrist worn tissue holder", "wrist worn handkerchief holder", "wrist worn tissue or handkerchief holder" and "tissue or handkerchief wrist holder" are interchangeable and refer to the wrist or arm worn tissue or handkerchief holder 100 of the present invention. As used herein "perforation" refers to the combination cuts and holes in a specified area, to delimitate the tissues.

Notwithstanding the forgoing, the portable dispenser 100, 200, and 300 of the present invention can be of any suitable size and configuration as is known in the art without affecting the overall concept of the invention, provided that it accomplishes the above stated objectives. One of ordinary skill in the art will appreciate that the size, configuration and material of the portable dispenser 100, 200, and 300 as shown in the FIGS. are for illustrative purposes only, and that many other sizes of the portable dispenser 100, 200, and 300 are well within the scope of the present disclosure. Although the dimensions of the portable dispenser 100, 200, and 300 are important design parameters for user convenience, the portable dispenser 100, 200, and 300 may be of any size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A portable dispenser comprising;

an adjustable wrist band comprising a first end and a second end cooperating to form a circumferentially extending band connectable via a closure; and a dispensing component disposed on an outer surface of the band, the dispensing component comprising a non-deformable cavity reservoir comprising a pair of mounting points for retaining a roll of a convenience product supported on a roll core, an opening for loading the roll of the convenience product into the nondeformable cavity reservoir, and a closure element for closing the opening; and wherein the pair of mounting points are configured to secure the roll core within the reservoir; and wherein the roll of the convenience product comprises a plurality of individual sheets connected by a line of perforations;

wherein the closure opening comprises a flap configured to fold over reconfiguring the opening to a slot for dispensing the plurality of individual sheets one by one through the slot; and wherein the closure element is a resealable adhesive.

* * * * *